US005967055A

United States Patent [19]

Schumacher

[11] Patent Number: 5,967,055

[45] **Date of Patent: *Oct. 19, 1999**

[54] CONVERTIBLE SCORING TABLE

[76] Inventor: Larry Schumacher, 9435 Wright Ave., Machesney Park, Ill. 61115

[ * ] Notice: This patent issued on a continued prosecution application filed under 37 CFR 1.53(d), and is subject to the twenty year patent term provisions of 35 U.S.C. 154(a)(2).

[21] Appl. No.: 08/759,246

[22] Filed: Dec. 2, 1996

[51] Int. Cl.[6] ..... A47B 83/00

[52] U.S. Cl. ..... 108/50.011; 108/77

[58] Field of Search ..... 312/249.8, 249.13, 312/205, 258, 309, 310, 314, 315, 316, 317.3; 108/78, 79, 77, 166, 124, 128, 134, 50.011, 44, 47

[56] References Cited

U.S. PATENT DOCUMENTS

| | | | |
|---|---|---|---|
| 144,769 | 11/1873 | Kade | 312/310 |
| 825,854 | 7/1906 | Mead | 108/79 |
| 835,902 | 11/1906 | Damato . | |
| 943,236 | 12/1909 | Campbell | 312/258 |
| 1,128,031 | 2/1915 | Needleman . | |
| 1,375,493 | 4/1921 | Drew | 312/316 |
| 2,810,617 | 10/1957 | Slanhoff . | |
| 3,333,766 | 8/1967 | Crossland et al. . | |
| 3,345,760 | 10/1967 | Myhr . | |
| 3,361,090 | 1/1968 | Howlett . | |
| 3,850,114 | 11/1974 | Ganteaume . | |
| 4,189,197 | 2/1980 | Walker, Jr. . | |
| 4,223,945 | 9/1980 | Nikitits . | |
| 4,519,318 | 5/1985 | Weldon-Ming . | |
| 4,579,401 | 4/1986 | Mears . | |
| 4,747,596 | 5/1988 | Harrison . | |
| 4,747,644 | 5/1988 | Gallery et al. . | |
| 5,405,192 | 4/1995 | McGrath . | |

FOREIGN PATENT DOCUMENTS

| | | | |
|---|---|---|---|
| 710910 | 6/1954 | United Kingdom | 108/79 |

OTHER PUBLICATIONS

U.S. application No. 08/759,247, Schumacher, filed Dec. 02, 1996.

*Primary Examiner*—Peter M. Cuomo
*Assistant Examiner*—Gerald A. Anderson
*Attorney, Agent, or Firm*—Keith Frantz

[57] ABSTRACT

A scoring table for use at sporting includes a table top, a front section adapted to support the forward portion of the table top, and legs adapted to support the rear portion of the table top. The legs are formed with upper and lower leg members. Each lower leg member is hinged to the respective upper leg member for movement between (1) a first position aligned with and extending downwardly from the upper leg member for supporting the rear portion of the table top from the floor and (2) a second position extending upwardly from the hinge and generally adjacent the upper leg member to allow the upper leg members to support the rear portion of the table top from a generally horizontal surface which is at a height above the floor such as a bleacher seat.

12 Claims, 7 Drawing Sheets

CONVERTIBLE SCORING TABLE

BACKGROUND OF THE INVENTION

This invention relates generally to scoring tables for use at sporting events by game personnel such as a timekeeper, a statistician, and a scorer.

More particularly, the invention relates to scoring tables of the type having a front panel section for supporting the front portion of the table and rear legs adapted to support the rear portion of the table.

Prior scoring tables of this type are typically adapted to be either free-standing, to enable the personnel to work at the table while sitting on chairs, or to be at least partially supported on bleachers, to enable the personnel to work at the table while sitting on the bleachers. The rear legs of bleacher-mounted scoring tables are adapted to rest on and support the rear portion of the table from either the first or second bleacher seat while the front section rests on either the floor or a bleacher seat forwardly of the rear legs.

One prior known scoring table is adapted to be convertible between free-standing and bleacher-mounted. In this instance, the rear legs sized to normally rest on the floor and are adapted to be removed, folded, or otherwise moved to an "out of the way" position such as extending laterally along the back of the front section, and additional "adapter" leg supports are secured to the table for supporting the rear portion of the table top on a seat of the bleachers.

Such prior convertible scoring tables require additional parts, usually supplied in a kit, including the adapter legs and typically fastening hardware such as nuts and bolts to secure the added supports to the table.

Unfortunately, these additional parts must be stored and may be lost when not installed onto the table. And converting one of these prior tables between bleacher-mounted and free-standing typically requires tools and the aid of, for example, maintenance personnel.

To reduce the space needed for storage of the scoring table, the rear legs of the scoring table and the rear portion of the table top are often adapted to fold into a storage position. For example, the legs may be adapted to fold into a position along the back of the front section and the rear portion of the table top may be adapted to fold downwardly adjacent and rearwardly of the folded legs. As a result, the overall width of the scoring table is substantially reduced.

In such collapsible scoring tables, however, the adapter legs of prior convertible tables must typically be removed from the table before the table can be folded and put into storage, and the supports and associated hardware must then be transported separately between the storage area and the location where the table is to be setup.

Thus, there is a need for a scoring table that is easily converted between free-standing and bleacher-mounted without the need for additional adapter supports, and that is also quickly and easily collapsible for storage.

SUMMARY OF THE INVENTION

The general aim of the present invention is to provide a new and improved convertible scoring table which is more easily converted between free-standing and bleacher-mounted.

Another aim of the invention is to provide such convertible features in a collapsible scoring table.

A detailed objective is to achieve the foregoing by providing rear support legs with two alternate lower support surfaces, either of which may be selectively exposed for supporting the rear portion of the table on either the floor or on a generally horizontal surface above the floor.

A more detailed objective is to provide for rear legs which include upper and lower leg members, each lower leg member being hinged to the respective upper leg member and adapted to swing approximately 180 degrees about a horizontal axis for selective movement between (1) a first position aligned with and extending downwardly from the upper leg member so that the upper and lower leg members coact to support the rear portion of the table from the floor, and (2) a second position extending upwardly from the hinge and adjacent the upper leg member so as to expose the lower edge surface of the upper leg member for supporting the rear portion of the table from, for example, a bleacher seat at a height above the floor.

Another more detailed objective is to adapt such leg members for selective positioning to either support the rear portion of the table top or to swing inwardly to allow the rear portion of the table top or to swing inwardly to allow the rear portion of the table top to swing down into a collapsed position.

These and other objectives and advantages of the invention will become more apparent from the following detailed description when taken in conjunction with the accompanying drawings.

Figure 1:
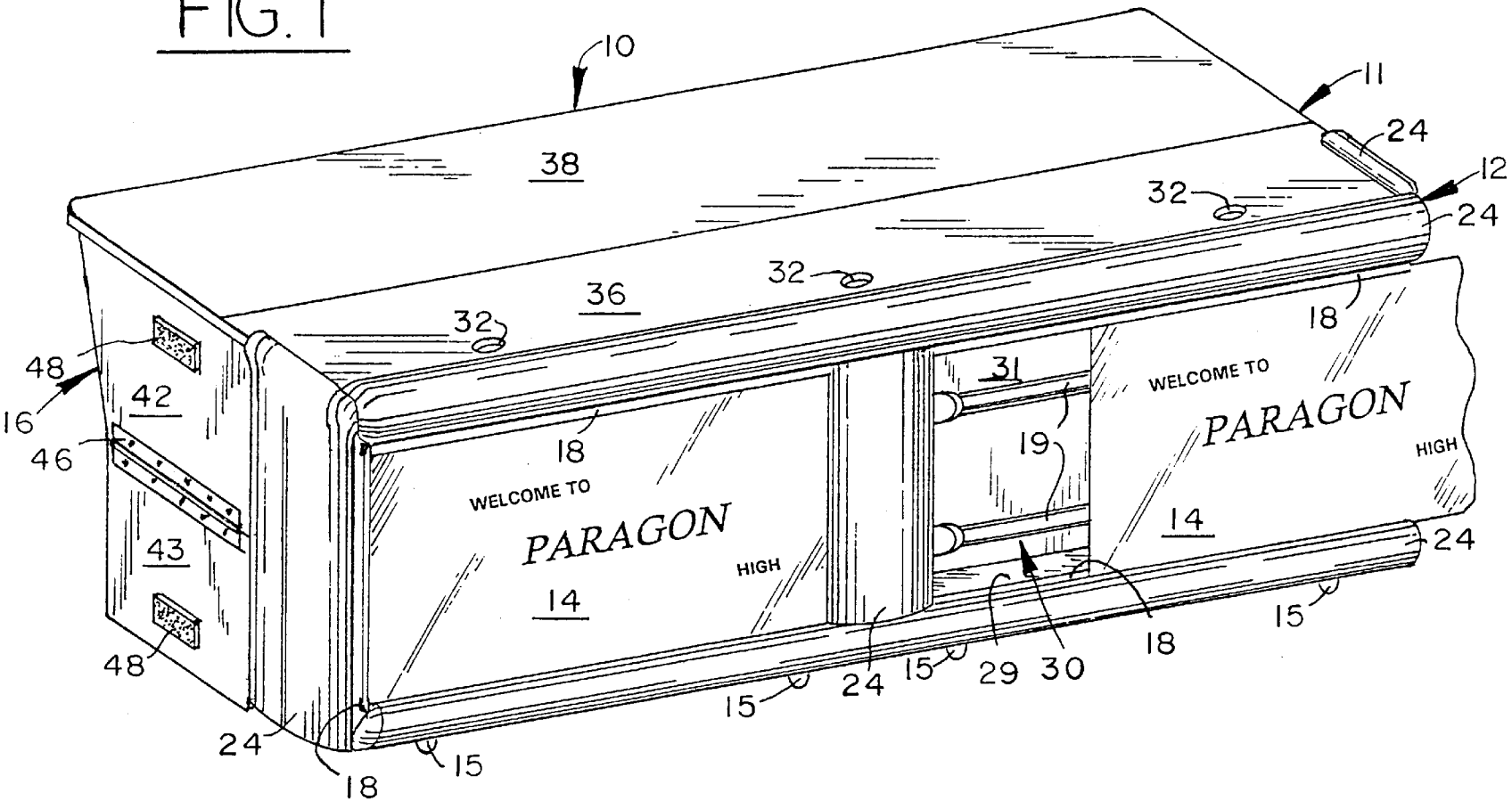
FIG. 1 is a perspective view of a new and improved scoring table incorporating the unique features of the present invention and showing the table free-standing.
Figure 2:
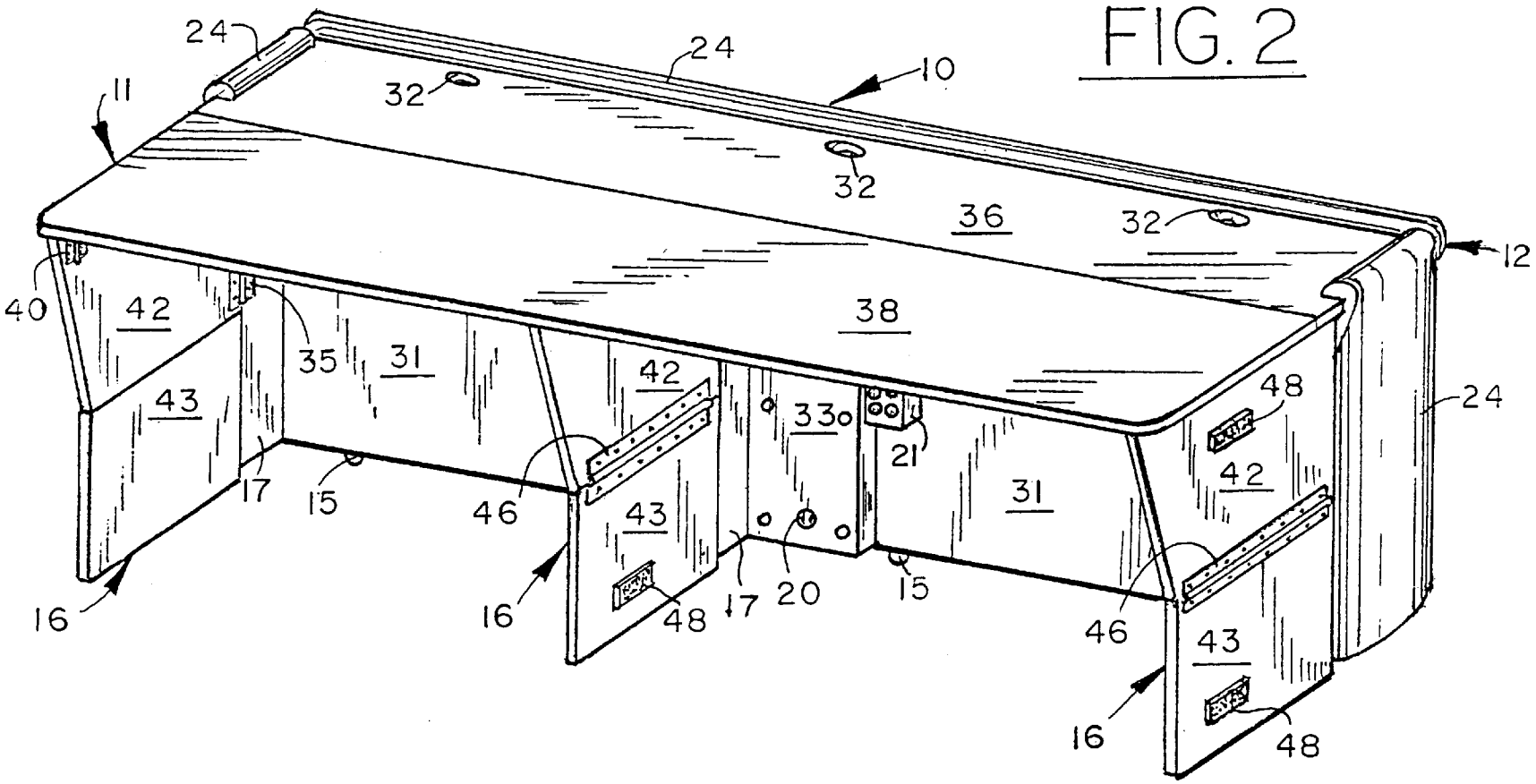
FIG. 2 is a perspective view of the back of the scoring table.

While the invention is susceptible of various modifications and alternative constructions, a certain illustrated embodiment has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE PREFERRED EMBODIMENT

For purposes of illustration, the present invention is shown in the drawings as embodied in a collapsible scoring table 10 (FIG. 1) for use at indoor sporting events by game personnel such as time keepers, statisticians, and scorer keepers.

The scoring table 10 includes a generally horizontal table top 11, a generally vertical front section 12 adapted to carry panels 14 for displaying such things as advertising, the name of a school, or the logo of a sports team, wheels 15 preferably pivotally mounted to the underside of the front section for supporting the front portion of the table, and legs 16 adapted to support the rear portion of the table top. With this arrangement, game personnel may be seated at and work comfortably from behind the table.

The display panels 14 are carried in tracks 18 secured to the front of the scoring table 10. The tracks are open along the outer sides for receiving the panels and are closed at the opposite and inwardly located sides to provide a stop for the panels as each panel is slid inwardly into its respective track. The outer corners of the panels are preferably rounded to reduce the likelihood of injury in the event that a panel is inadvertently knocked outwardly and extends beyond the edge of the table. The table may optionally include fluorescent lights 19 or other lighting means behind the display panels for illuminating the panels. In this instance, the panels are made from a material suitable to allow at least a portion of the light to pass through such as from translucent lexan.

Figure 5:
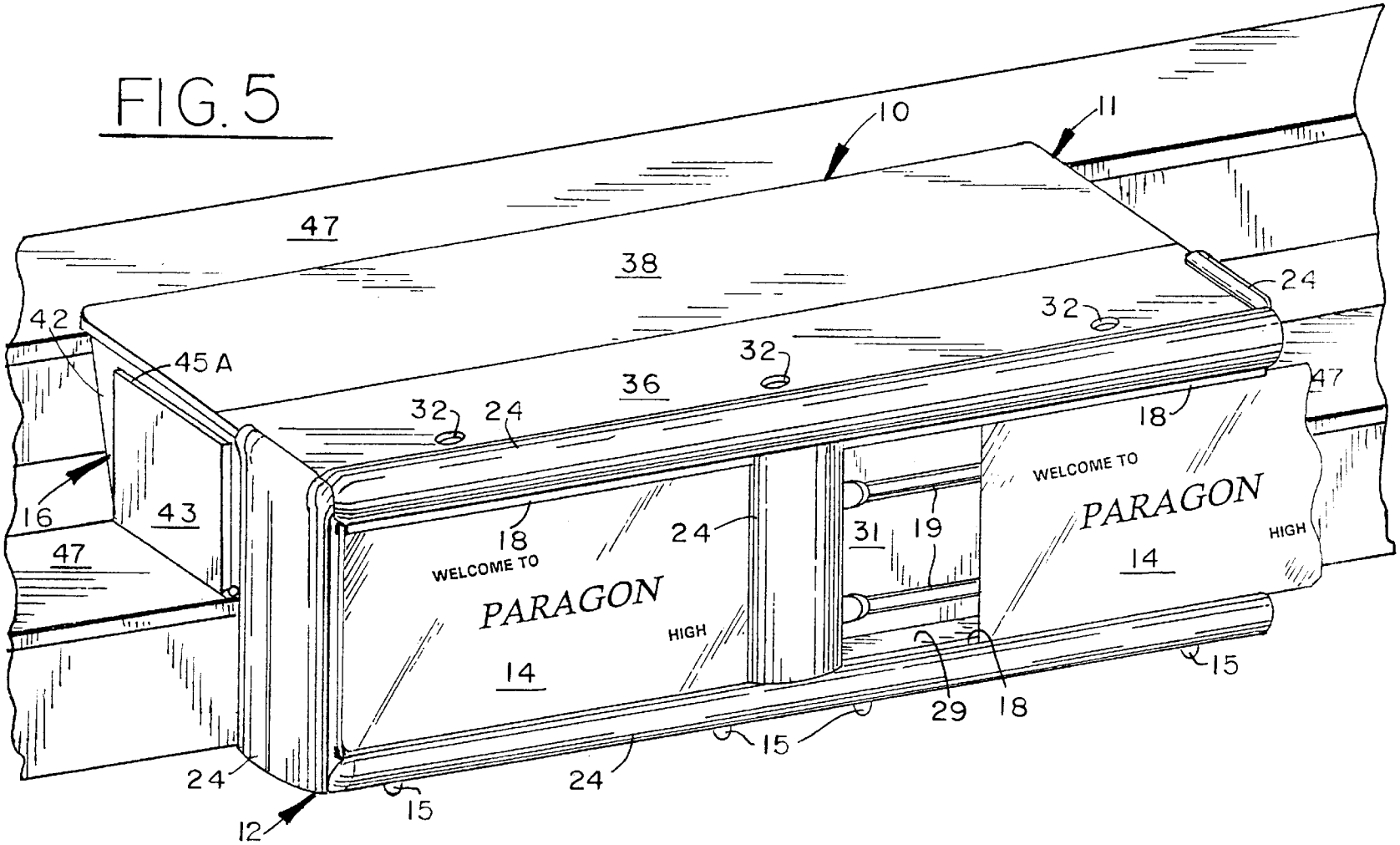
FIG. 5 is a view similar to FIG. 1 but showing the table bleacher-mounted.

An electrical extension cord (not shown) may be plugged into receptacle 20 to supply electric power to the scoring table 10. Electrical wiring 22 (FIG. 5) in the table carries the power from the receptacle 20 to an electrical outlet box 21, and to, for example, the lights 19.

At many sporting events, a scoring table 10 may be located relatively close to the playing area. For example, at a basketball game, the scoring table is typically located to one side of the court, at approximately center court. A typical scoring table is approximately three to four feet wide. As a result, the forward portion of the table may be in relative close proximity to the edge of the playing court.

To protect players from injury in the event that a player falls, bumps, or gets pushed into the edges or corners of the scoring table 10 during a game, relatively thick, vinyl-covered foam padding 24 or other suitable padding is secured to all otherwise exposed edges of the forward portion of the table.

In the embodiment illustrated, the front section 12 of scoring table 10 includes a generally rectangular frame structure 25 (see FIG. 4 in which for illustrative purposes only, the table 10 is shown without the padding 24, the panels 14, and various other components) to carry the tracks 18 and at least a substantial portion of the padding 24. The frame 25 includes opposing outer side members 17, various front members 28, and a floor member 29 (FIG. 3), the wheels being secured to the underside of the floor 29. The fluorescent lights 19 are located in enclosures 30 defined within in the frame structure. Back panels 31 close the back side of these enclosures and generally close off the back of the frame.

Openings 32 formed in the table top 11 rearwardly of the back panels 31 allow electrical cords from equipment which may be located on the table to be feed therethrough, thus enabling the cords to be plugged into the electrical outlet box 21 without having the cords dangling over the back edge of the table top.

The electrical wiring 22 is located generally and may optionally be located completely within the center of the front section 12 between side members 34. Advantageously, the opposing sides 34 define the inwardly located sides of enclosures 30. The wiring is accessible for maintenance through a rear access panel 33 which is pivotally or removably secured to the back of the frame structure 25 with, for example, screws along the sides of the panel.

The table top 11, frame structure 25, and legs 16 may be formed from any commonly available and suitable material such as, for example, wood, molded reinforced plastic, or sheet metal.

In the embodiment illustrated, the legs 16 and the table top 11 are adapted to fold or collapse to reduce the overall width of the scoring table 10. This enables the table to be more easily moved from place to place, such as between the court and a storage area, and reduces the space needed for storage of the table.

Figure 3:
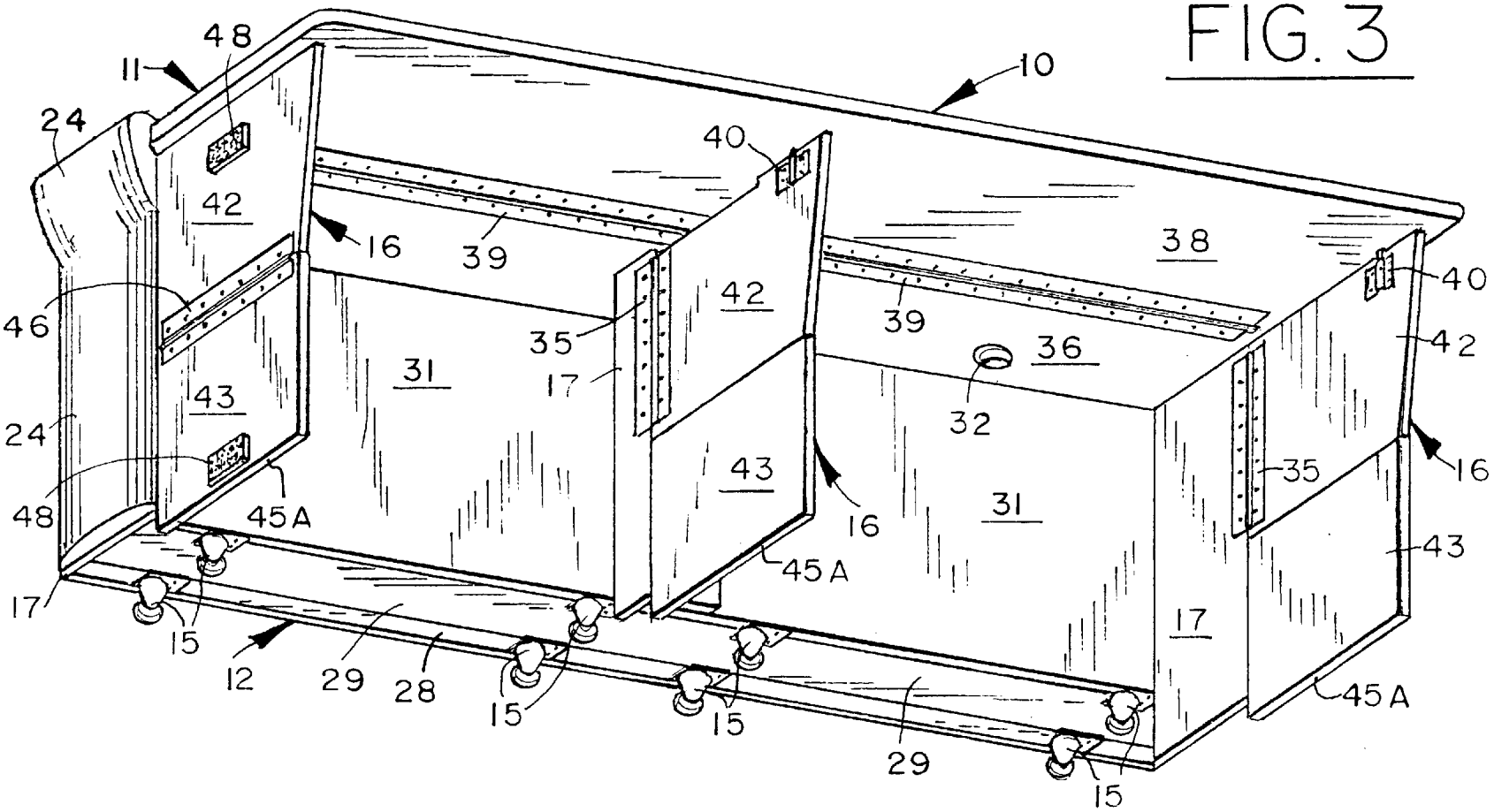
FIG. 3 is a lower perspective view of the back of the scoring table as viewed looking upwardly from the floor.
Figure 4:
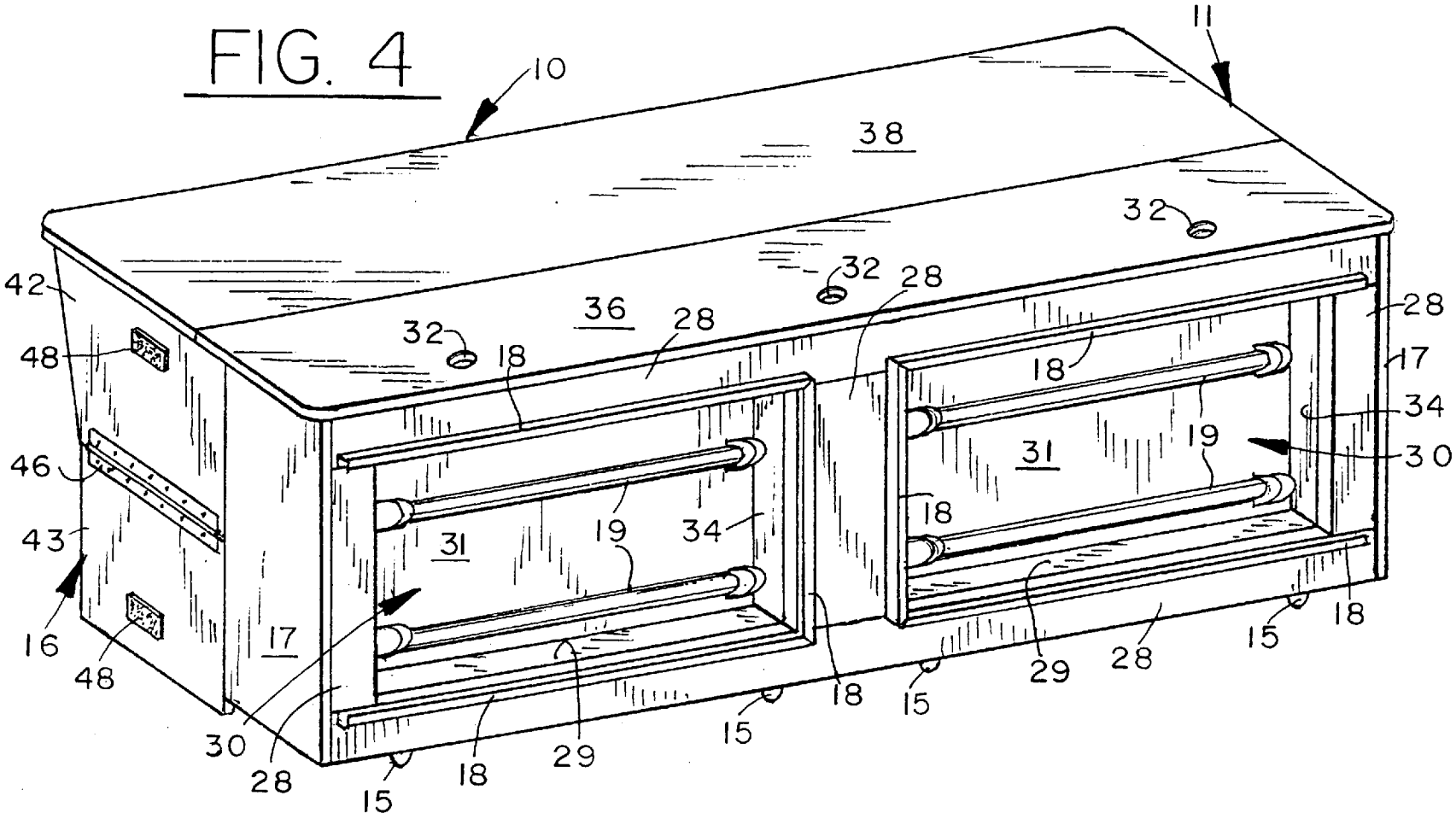
FIG. 4 is a view similar to FIG. 1 with certain parts not shown.
Figure 8:
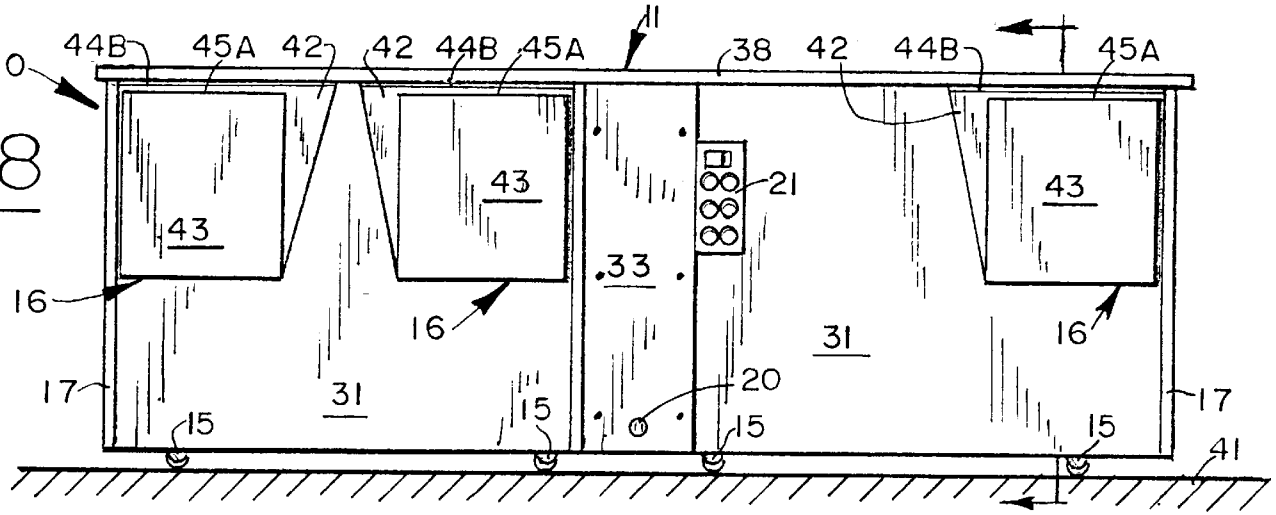
Figure 9:
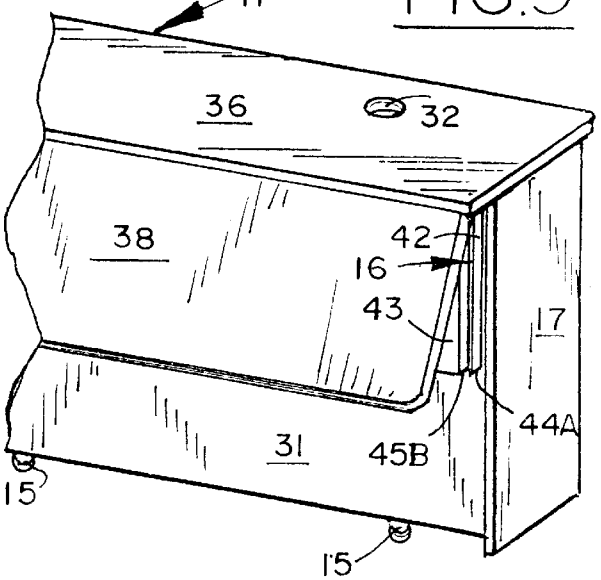
FIG. 9 is a fragmentary perspective view of the table showing the rear portion of the table top being lowered into a collapsed position after the rear legs have been folded, but with certain parts not shown.
Figure 10:
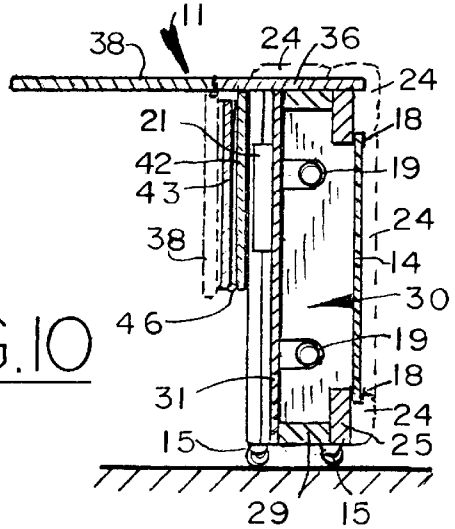
FIG. 10 is a cross-sectional view taken substantially along the line 10—10 of FIG. 8, but with certain parts not shown.

More specifically, the legs 16 are connected to the frame 25 by hinges 35 (FIG. 3). Each hinge 35 is adapted to swing through an arc of at least 90 degrees about a vertical axis for movement of the leg between (1) an operative position extending generally rearwardly from the frame as shown in FIGS. 1–4, and (2) a folded position pivoted approximately 90 degrees from the operative position and extending longitudinally along the back of the frame as shown in FIGS. 8–10. The table top 11 includes a front portion 36 secured to and generally overlying the forward section 12, and a rear portion 38 which is connected to the front portion 36 by hinge 39. The hinge 39 is adapted to swing through an arc of at least 90 degrees about a horizontal axis for movement of the rear portion 38 of the table top between (1) a horizontal working position aligned with the forward portion of the table top to create the horizontal working surface as shown in FIGS. 1–4, and (2) a folded position extending downwardly from the hinge 39 after the legs 16 have been first pivoted into their folded positions as shown in FIG. 9 and in dashed lines in FIG. 10. With this arrangement, the rear portion 38 of the table top 11 is supported in the working position by the legs 16 when the legs are moved into the rearwardly extending operative position. And the wheels 15 are arranged under the frame so as to support the collapsed table without the aid of the legs 16.

Locking means for securing the legs 16 in the operative position are preferably included on the scoring table 10. To this end, a sliding bolt-type lock 40, for example, may fastened to each leg and adapted to selectively lock the legs into position under the rear portion 38 of the table top 11 by engaging a pre-drilled blind opening formed in the underside of the table top.

In accordance with the present invention, the rear support legs 16 are uniquely adapted to provide alternate support surfaces which may be selectively exposed for supporting the rear portion 38 of the table top 11 in a horizontal position from either of two predetermined heights. More specifically, each leg is provided with a support member 43 that is adapted for relatively quick and easy movement between two alternate positions, the member 43 being adapted to expose a different lower supporting surface of the leg 16 in each of the two positions. As a result, the scoring table includes integral means for allowing the table to be quickly and easily converted between a bleacher-mounted table and a free-standing table, without the need to add additional parts to or remove parts from the scoring table.

Figure 7:
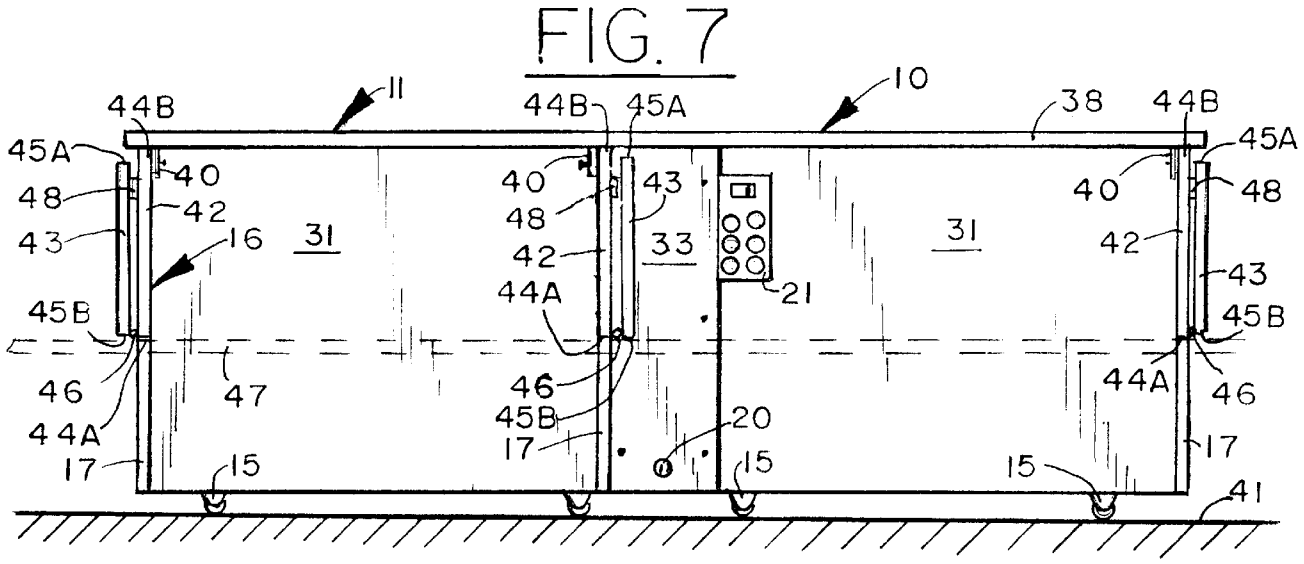
FIGS. 6–8 are rear views of the scoring table showing the steps of folding collapsible rear support legs when considered in sequence, but with certain parts not shown.
Figure 6:
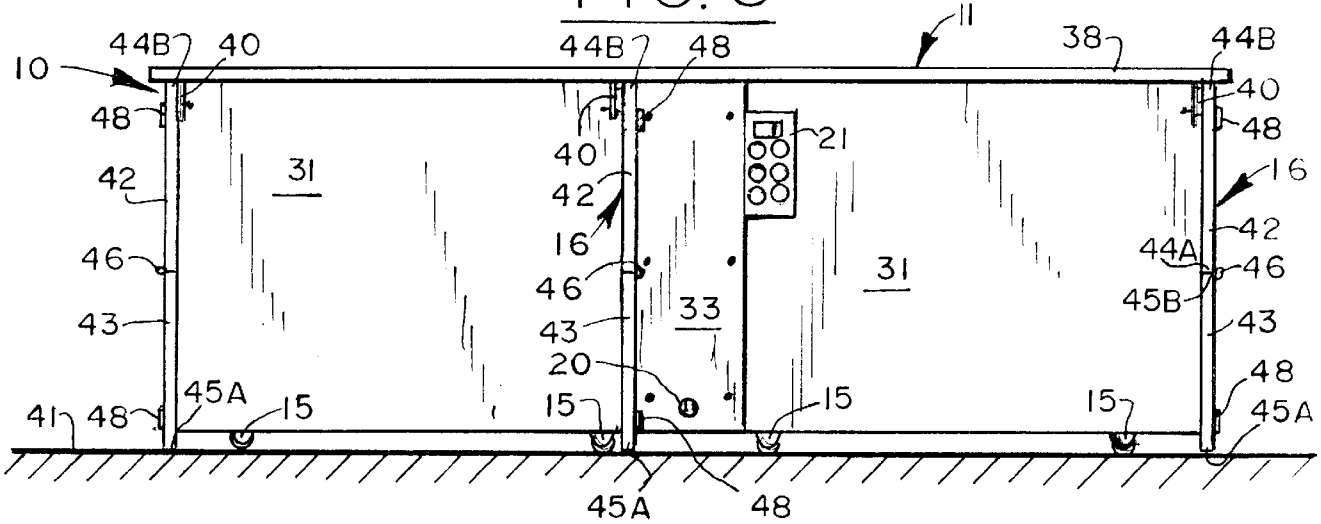

In carrying out the invention, the legs 16 are split into upper and lower leg sections or members, 42 and 43, respectively, each member having generally vertically facing edge surfaces, 44A, 44B, and 45A, 45B, respectively, (FIG. 7). The upper leg members 42 are pivotally connected to the frame 12 by the hinges 35 as discussed above, the rear portion 38 of the table top 11 resting on the upper surface 44B when the legs are in the operative or supporting position. The lower leg members 43 are pivotally connected to the respective upper leg members 42 by hinges 46. The hinges 46 are adapted to swing through an arc of approximately 180 degrees about a horizontal axis for movement of each lower leg member 43 between (1) a first or "down" position aligned with and extending downwardly from the upper leg member 42 as shown in FIG. 6, and (2) a second or "up" position extending upwardly from the hinge and in proximate parallel relation to the upper leg member as shown in FIG. 7.

When the lower leg members 43 are in the down position, the edge surfaces 45A are exposed and facing downwardly for resting on and supporting the rear portion 38 of the table top 11 from a generally horizontal first surface at a predetermined height. With the lower leg members thusly positioned, the edge surfaces 45B and 44A are in face-to-face relation and not exposed or available for supporting the table.

Raising or pivoting the lower leg members 43 to the up position causes the edge surfaces 45B to rotate about the hinge 46 axis into an exposed and downwardly facing edge surfaces 44A of the upper leg members. With the lower leg member thusly positioned, the edge surfaces 45B and especially edge surfaces 44A are available for resting on and supporting the rear portion of the table from a second generally horizontal surface at a predetermined height above the first surface. The edge surfaces 45A now face upwardly and are not available for supporting the table (see FIG. 7).

With the foregoing arrangement, the leg members 42, 43 coact to support the table from, for example, a floor 41, when the lower leg members 43 are down. With the lower leg members up, the upper leg members 42 are adapted to support the table from, for example, a bleacher seat 47.

The steps in preparing the scoring table 10 for storage are illustrated generally in FIGS. 6 through 9. To prepare the table for storage, the lower leg members 43 are pivoted upwardly, if not already in this position from resting on a bleacher seat 47 (see FIG. 7), and the legs 16 are then pivoted inwardly 90 degrees to the folded position (see FIG. 8). The rear portion 38 of the table top 11 is then lowered to its vertical position, adjacent but rearwardly of the folded legs as shown in FIG. 9 and in dashed lines in FIG. 10. Setting up the table after it has been relocated or removed from storage simply requires raising the rear portion of the table top to a horizontal position and then pivoting the legs outwardly and optionally lowering the lower leg members to support the rear portion of the table top from the desired surface.

In the embodiment illustrated, the edge surfaces 44A of upper leg members 42 are straight and generally horizontal for resting on a flat, for example, bleacher seat when the lower leg members 43 are up. However these edge surfaces 44A may also be formed with a predefined profile adapted to compliment, for example, a seat which has been formed with a predefined curvature. In this instance, the hinges 46 are positioned so that when the lower leg members have been pivoted to the up position, the edge members 45B swing "out of the way" to fully expose the edge surfaces 44A for supporting the table.

Provisions are also included in the scoring table 10 for selectively maintaining the lower leg members 43 in either the up or down positions. Preferably, the lower leg members are maintained in the down position by virtue of the weight of the table top 11 resting on the legs 16, and may be maintained in the up position by, for example, complimentary Velcro patches 48 secured to the upper and lower leg members 43, or by other suitable and preferably quick-release fastening means.

From the foregoing, it will be apparent that present invention brings to the art a new and improved collapsible scoring table 10 which includes uniquely configured support legs 16 equipped with integral lower leg member 43 adapted for selective use in supporting the rear portion 38 of the table top 11. Accordingly, the table may be quickly and easily converted by one person between a free-standing table and a bleacher-mounted table without the need for tools or additional parts.

I claim:

1. A scoring table adapted for conversion between free-standing on a floor and bleacher-mounted, the table comprising:

a frame having an upper portion and a lower portion, and having a front side portion and a back side portion;

a table top having a front portion connected to the upper portion of said frame, and a rear portion connected to said front portion;

upper leg means connected to at least one of said rear portion and said frame;

said upper leg means being in an operative position extending under the rear portion of said table top toward the floor and being sized to support said rear portion in a substantially horizontal working position when positioned over a bleacher;

lower leg means pivotally connected for swinging between a supporting position disposed between said upper leg means and the floor, and a non-operative position disposed adjacent and generally parallel to said one of said upper leg means and the back side portion of said frame so as to provide access clearance for resting said upper leg means on the bleacher.

2. A scoring table as defined in claim 1 in which said lower leg means is pivotally connected to said upper leg means, said table further comprising means for releasably retaining said lower leg means in said non-operative position.

3. A scoring table as defined in claim 2 in which said lower leg means is pivotally connected for swinging through an arc of approximately 180 degrees between said supporting position and said non-operative position.

4. A scoring table as defined in claim 1 in which:

the rear portion of said table top is pivotally connected to said front portion for swinging about a horizontal axis between said working position and a substantial vertical folded position in spaced relation with the back side portion of said frame for providing a storage space therebetween;

said upper leg means are pivotally connected to said back side portion for swinging, when said rear portion is in said working position, between said operative position and a stored position in said storage space to enable lowering the rear portion of said table top into said folded position.

5. A scoring table adapted for conversion between free-standing on a floor and bleacher-mounted, the table comprising:

a frame having an upper portion and a lower portion, and having a front side and a back side;

a table top having a front portion connected to the upper portion of said frame, and a rear portion pivotally connected for swinging about a horizontal axis between a substantially horizontal working position extending rearwardly from said front portion, and a folded position extending toward the floor, and in spaced relation with the back side of said frame for providing a storage space therebetween;

upper leg means pivotally connected for swinging, when said rear portion is in said working position, between an operative position extending from under the rear portion of said table top and toward the floor, and a stored position in said storage space;

said upper leg means being sized to support the rear portion of said table top in said working position when positioned over a bleacher;

lower leg means pivotally connected to said upper leg means for swinging about a horizontal axis through an arc of approximately 180 degrees between a down position disposed and between said upper leg means and the floor and in supporting relation therebetween, and an up position disposed adjacent and generally parallel to said upper leg means; and means for releasably retaining said lower leg means in said up position;

said lower leg means swinging together with said upper leg means into said storage space to enable lowering the rear portion of said table top into said folded position.

6. A scoring table adapted for conversion between free-standing on a floor and bleacher-mounted, the table comprising:

a generally rectangular body having a top and a bottom, and a front side and a back side;

wheels connected to the bottom of said body and in rolling contact with the floor;

a table top having a front portion fixed to the top of said body, and a rear portion;

first hinge means connecting the front and rear portions of said table top;

the rear portion of said table top being connected for swinging about a horizontal axis between a substantially horizontal working position, and a folded position extending from said first hinge means toward the floor, and in spaced relation with the back side of said body for providing a storage space therebetween;

upper leg means pivotally connected to said body for swinging about a vertical axis between an operative position extending under the rear portion of said table top and toward the floor when said rear portion is in said working position, and sized to support said rear portion in said working position when positioned over bleacher, and a stored position in said storage space;

lower leg means;

second hinge means pivotally connecting said lower leg means with said upper leg means;

said lower leg means being connected for swinging about a horizontal axis through an arc of approximately 180 degrees between a down position disposed between said upper leg means and the floor, and an up position extending from said second hinge means toward the rear portion of said table top when said rear portion is in said working position and disposed adjacent said upper leg means; and means for releasably connecting said lower leg means to said upper leg means for selectively positioning said lower leg means in said up position said lower leg means swinging together with said upper leg means into said storage space to enable lowering the rear portion of said table top into said folded position.

7. A scoring table adapted for conversion between free-standing on a floor and bleacher-mounted, the table comprising:

front support means having an upper portion and a lower portion, and having a front side portion and a back side portion;

a table top having a front portion connected to the upper portion of said front support means, and a rear portion connected to said front portion; and folding leg means, connected to at least one of said front support means and said table top, for alternately supporting the rear portion of said table top in a substantially horizontal working position from a floor and from a bleacher.

8. A scoring table as defined in claim 7, in which said folding leg means includes upper leg means in contacting relation with the underside of the rear portion of said table top, and lower leg means pivotally connected for swinging between a supporting position disposed between said upper leg means and the floor, and a second position out of supporting relation with respect to between said upper leg means and the floor, and providing access clearance for resting said folding leg means on the bleacher.

9. A scoring table as defined in claim 8 in which said upper leg means in sized to support said rear portion in said working position when positioned on the bleacher, and in which said lower leg means is disposed, when in said second position, generally parallel to one of said upper leg means and the back side portion of said frame in a non-supporting relationship for providing said clearance for resting said upper leg means on the bleacher.

10. A scoring table as defined in claim 9 in which said lower leg means is pivotally connected to said upper leg means for swinging about a horizontal axis through an arc of approximately 180 degrees between said supporting position and said second position, said table further comprising means for releasably retaining said lower leg means in said second position.

11. A scoring table as defined in claim 7 in which:

the rear portion of said table top is pivotally connected to said front portion for swinging about a horizontal axis between said working position and a substantial vertical folded position proximate said back side portion; and said folding leg means is pivotally connected for swinging to a non-supporting storage position to enable lowering the rear portion of said table top into said folded position.

12. A scoring table as defined in claim 11 in which said rear portion, when in said folded position, is in spaced relation with said back side portion for providing a storage space therebetween, and in which said folding leg means is positioned in said storage space when in said storage position.

* * * * *